US010428505B2

(12) United States Patent
Wang et al.

(10) Patent No.: US 10,428,505 B2
(45) Date of Patent: Oct. 1, 2019

(54) FLUSHING TOILET COVER

(71) Applicant: WDI (Changtai) Technology Co., Ltd., Fujian (CN)

(72) Inventors: Jinjiang Wang, Fujian (CN); Huiqing Wang, Fujian (CN); Zhaoxi Li, Fujian (CN)

(73) Assignee: Changtai Yike Technology Co., Ltd., Zhangzhou, Fujian (CN)

( * ) Notice: Subject to any disclaimer, the term of this patent is extended or adjusted under 35 U.S.C. 154(b) by 122 days.

(21) Appl. No.: 15/577,908

(22) PCT Filed: Sep. 1, 2017

(86) PCT No.: PCT/CN2017/100127
§ 371 (c)(1),
(2) Date: Nov. 29, 2017

(87) PCT Pub. No.: WO2018/192155
PCT Pub. Date: Oct. 25, 2018

(65) Prior Publication Data
US 2018/0305914 A1 Oct. 25, 2018

(51) Int. Cl.
*E03D 9/08* (2006.01)

(52) U.S. Cl.
CPC ..... *E03D 9/08* (2013.01)

(58) Field of Classification Search
CPC ..... E03D 9/08
(Continued)

(56) References Cited

FOREIGN PATENT DOCUMENTS

CN 200946707 Y 9/2007
CN 101294414 A 10/2008
(Continued)

*Primary Examiner* — Christine J Skubinna
(74) *Attorney, Agent, or Firm* — Muncy, Geissler, Olds & Lowe, P.C.

(57) ABSTRACT

The present invention discloses a flushing toilet cover. The flushing toilet cover comprises a seat, a cover plate and a shell, wherein the rear portion of the seat and the rear portion of the cover plate are hinged to the shell, and a pressure-reduction and flow-stabilization valve, a heating assembly, a switch valve, a flushing assembly and a control panel are mounted in the shell; the pressure-reduction and flow-stabilization valve is provided with a water inlet channel and a water outlet channel, the switch valve is provided with a water inlet and at least one water outlet, the flushing assembly comprises at least one flushing pipe, telescopic flushing spray heads are mounted on the flushing pipes, and water inlets are formed in the flushing pipes; the water inlet channel of the pressure-reduction and flow-stabilization valve communicates with an external water inlet pipe, the water outlet channel of the pressure-reduction and flow-stabilization valve communicates with a water inlet of the heating assembly through a pipeline, a water outlet of the heating assembly communicates with the water inlet of the switch valve, and the water outlets of the switch valve communicate with the water inlets of the flushing pipes; the control panel controls the operating state of the heating assembly, and when the switch valve is in the closed state, the water inlet channel and the water outlet channel of the pressure-reduction and flow-stabilization valve are blocked. The flushing toilet cover of the present invention is quite simple in structure and control and low in cost and can achieve flushing when power failures occur.

10 Claims, 13 Drawing Sheets

(58) Field of Classification Search
USPC ..... 4/447
See application file for complete search history.

(56) References Cited

FOREIGN PATENT DOCUMENTS

| | | | |
|---|---|---|---|
| CN | 201195881 | Y | 2/2009 |
| CN | 201288868 | Y | 8/2009 |
| CN | 205857332 | U | 1/2017 |
| CN | 106894487 | A | 6/2017 |
| CN | 206693346 | U | 12/2017 |
| CN | 206693347 | U | 12/2017 |
| JP | 2015161161 | A | 9/2015 |
| KR | 20140086634 | A | 7/2014 |

FLUSHING TOILET COVER

BACKGROUND OF THE INVENTION

Technical Field

The present invention relates to the technical field of manufacturing of toilet covers, in particular to a flushing toilet cover.

Description of Related Art

In the flushing process of an existing flushing toilet cover, to prevent the heating power from being increased and to ensure maximum water temperature response, the flushing flow generally needs to be controlled between the range of 400 ml/Min to 1200 ml/Min; to meet this requirement for flow stability, a pressure-reduction and flow-stabilization valve assembly needs to be installed on the flushing toilet cover to ensure flow stability under different working water pressure conditions. To prevent high pressure at the front water supply end from transmitting to a water outlet pipe of the flushing toilet cover, causing a hose and a hose connector to be disengaged and consequentially causing leakage, a normally-closed electromagnetic valve assembly is added to the front end of the pressure-reduction and flow-stabilization valve assembly of the flushing toilet cover on the market, the electromagnetic valve is closed before the flushing toilet starts to work, and the functions of disconnecting the flushing toilet cover from the high-pressure of the water supply pipeline and protection of the hose and the hose connector are achieved; the electromagnetic valve starts to work after a cleaning signal is received. However, this type of setup leads to complex structure and control of the flushing toilet cover and increases the manufacturing cost of the flushing toilet cover, is disadvantageous for the structural arrangement of the flushing toilet cover, and flushing cannot be conducted in the case of power failure.

BRIEF SUMMARY OF THE INVENTION

The present invention solves the technical problem of providing a flushing toilet cover which is more simplified in structure and control, lowers manufacturing costs. and can achieve flushing when power failures occur.

According to the technical scheme adopted by the present invention for achieving the above purpose, a flushing toilet cover comprises a seating ring, a cover plate and a shell, wherein the rear portion of the seating ring and the rear portion of the cover plate are hinged to the shell, a pressure-reduction and flow-stabilization valve, a heating assembly, a switch valve, a flushing assembly and a control panel are mounted in the shell, the pressure-reduction and flow-stabilization valve is provided with a water inlet channel and a water outlet channel, the switch valve is provided with a water inlet and at least one water outlet, the flushing assembly comprises at least one flushing pipe, telescopic flushing spray heads are mounted on the flushing pipes, and water inlets are formed in the flushing pipes;

the water inlet channel of the pressure-reduction and flow-stabilization valve communicates with an external water inlet pipe, the water outlet channel of the pressure-reduction and flow-stabilization valve communicates with a water inlet of the heating assembly through a pipeline, a water outlet of the heating assembly communicates with the water inlet of the switch valve, and the water outlets of the switch valve communicate with the water inlets of the flushing pipes;

the control panel controls the operating state of the heating assembly, and when the switch valve is in the closed state, the water inlet channel and the water outlet channel of the pressure-reduction and flow-stabilization valve are blocked.

Preferably, the switch valve is provided with two water outlets, the flushing assembly comprises two flushing pipes, a telescopic flushing spray head is mounted on each flushing pipe, and a water inlet is formed in each flushing pipe; the two water outlets on the switch valve communicate with the water inlets on the two flushing pipes through two pipelines correspondingly, a rotary knob is mounted on the switch valve, and the switch valve can be made in the closed state or the water inlet of the switch valve can communicate with one water outlet on the switch valve by rotating the rotary knob. Flushing operation can be conducted conveniently by rotating the rotary knob.

According to the further improvement, an electromagnetic reversing valve and a self-cleaning pipe are further mounted in the shell, the electromagnetic reversing valve is provided with a first port, a second port and a third port, the self-cleaning pipe is provided with a water inlet and at least one water outlet, the water outlet of the heating assembly communicates with the first port of the electromagnetic reversing valve through a pipeline firstly, the water inlet of the switch valve then communicates with the second port of the electromagnetic reversing valve through a pipeline, the third port of the electromagnetic reversing valve communicates with the water inlet of the self-cleaning pipe through a pipeline, and the self-cleaning pipe is arranged above the flushing spray heads, and the water outlets of the self-cleaning pipe are aligned with water spray nozzles of the flushing spray heads when the flushing spray heads do not operate; when the electromagnetic reversing valve is powered on, the first port communicates with the third port, and when the electromagnetic reversing valve is powered off, the first port communicates with the second port; when the control panel judges that water flows through the heating assembly, the electromagnetic reversing valve is powered on for a set time and then is powered off. In this way, the flushing spray heads of the present invention can be cleaned automatically, reliability of the flushing action is ensured, and the flushing safety and flushing comfort can be improved.

Preferably, the heating assembly comprises an inner cavity and an electric heating pipe arranged in the inner cavity, a flow sensor is arranged at the water inlet of the heating assembly and electrically connected with the control panel, when the switch valve is opened, the flow sensor detects a flow signal and transmits the flow signal to the control panel, and the electric heating pipe in the heating assembly is powered on through the control panel and then starts heating.

Preferably, the pressure-reduction and flow-stabilization valve comprises a valve body and a valve element, the water inlet channel and the water outlet channel are arranged on the valve body, an inner cavity of the valve body is divided into a high-pressure cavity and a low-pressure cavity by an interlayer, the high-pressure cavity communicates with the water inlet channel, the low-pressure cavity communicates with the water outlet channel, and a first communicating hole is formed in the interlayer and communicates with the high-pressure cavity and the low-pressure cavity; the valve element penetrates through the first communicating hole to be located in the low-pressure cavity, and the other end of the valve element is located in the high-pressure cavity; a membrane is mounted on the side, located in the low-pressure cavity, of the valve body, one end of the valve element is fixedly connected with the membrane, and a compression spring is connected to the side, away from the high-pressure cavity, of the membrane; a concave cavity is formed in the side, located in the high-pressure cavity, of the valve body, the other end of the valve element is inserted into the concave cavity, and a sealing ring is arranged between the outer side face of the other end of the valve element and the inner side face of the concave cavity; a second communicating hole is formed in the valve element and communicates with the low-pressure cavity and the bottom of the concave cavity; a sealing gasket is fixedly connected to the side, located in the high-pressure cavity, of the interlayer and located on the periphery of the first communicating hole, a shoulder is arranged on the portion, located in the high-pressure cavity, of the valve element, when the pressure of the low-pressure cavity is increased to a set value, the water pressure of the low-pressure cavity drives the membrane, is transmitted to the concave cavity through the second communicating hole, and then overcomes the elastic force of the compression spring to push the valve element to move towards the low-pressure cavity until the sealing gasket is pressed by the end face of the shoulder, and the first communicating hole is sealed. By adoption of the pressure-reduction and flow-stabilization valve which is compact in structure and reliable in action, it is ensured that when water stops flowing out of the water outlet channel, namely when the switch valve is closed, the high-pressure cavity and the low-pressure cavity are disconnected, high pressure at the front water supply end is isolated, and a hose and a hose connector at the rear end of the pressure-reduction and flow-stabilization valve are protected.

According to the further improvement, a first annular protrusion extends out from the side, located in the high-pressure cavity, of the interlayer and located on the periphery of the first communicating hole, the sealing gasket surrounds the first annular protrusion, the thickness of the sealing gasket is smaller than the height of the first annular protrusion, an annular groove is formed in the end, matched with the sealing gasket, of the shoulder, the first annular protrusion can stretch into the annular groove, and when the first annular protrusion stretches into the annular groove, a gap is reserved between the inner circumference surface of the annular groove and the outer circumferential surface of the first annular protrusion. In this way, the sealing gasket is prevented from deforming or rushing out by squeezing of high-pressure water, the flow section of water entering the low-pressure cavity from the high-pressure cavity can be well adjusted, and better pressure reduction and flow stabilization functions are achieved.

Furthermore, a first chamfer is arranged at the end, close to the first annular protrusion, of the inner circumferential surface of the annular groove, and a second chamfer is arranged at the end, close to the annular groove, of the inner circumferential surface of the first annular protrusion; the first chamber can be used for guiding, and the second chamfer can allow water to flow through the first communicating hole conveniently;

a plurality of convex ribs are arranged at the junction of the inner side face of the valve body and the side, located in the high-pressure cavity, of the interlayer at intervals, and the height of the convex ribs is smaller than the height of the first annular protrusion. Through the multiple convex rings, the situation that the sealing gasket is not mounted in place can be prevented.

Preferably, the second communicating hole comprises a first radial through hole which is formed in the portion, located in the low-pressure cavity, of the valve element, a U-shaped groove which is formed in the end, located in the high-pressure cavity, of the valve element, and an axial hole which communicates with the first radial through hole and the U-shaped groove and is located on the valve element.

Preferably, the valve body comprises a valve body part, a first cover body and a second cover body, the water inlet channel and the water outlet channel are arranged on the valve body part, the interlayer is arranged in the middle of an inner cavity of the valve body part, the first cover body is fixedly connected with one end of the valve body part, the second cover body is fixedly connected with the other end of the valve body part, the low-pressure cavity is formed by the first cover body, one side of the interlayer and the inner wall of the valve body part, the high-pressure cavity is formed by the second cover body, the other side of the interlayer and the inner wall of the valve body part, the membrane is clamped between the first cover body and one end of the valve body part, and the compression spring is located between the first cover body and the membrane. The valve body of the structure is convenient to manufacture and assemble.

Furthermore, metal gaskets are arranged on the two sides of the middle of the membrane respectively, one end of the valve element penetrates through the two metal gaskets and the membrane and is screwed with a locking nut, one end of the valve element, the two metal gaskets and the membrane are fixedly connected together by screwing the locking nut, a through hole is formed in the middle of the outer end face of the first cover body, an adjusting nut is connected to the through hole in a screwed mode, one end of the compression spring abuts against one metal gasket, and the other end of the compression spring abuts against the adjusting nut; the elastic force of the compression spring can be adjusted by rotating the adjusting nut, and thus operating parameters of the whole pressure-reduction and flow-stabilization valve can be adjusted conveniently;

flanges extend out from the edges of the metal gaskets, a plurality of lugs are arranged on the side, located in the low-pressure cavity, of the interlayer, the compression spring is prevented from continuing to drive the membrane to move towards the high-pressure cavity when the flanges, located in the low-pressure cavity, of the metal gaskets make contact with the lugs, and a water channel is formed by the space between the adjacent lugs; in this way, the membrane can be well protected, and excessive deformation of the membrane is prevented. It can also be ensured that water flows out from the water outlet channel;

a second annular protrusion extends from the side, close to the interlayer, of the second cover body, and the sealing gasket is pressed by the end face of the second annular protrusion; a stepped concave hole which becomes larger from inside to outside is formed in the middle of the second annular protrusion, the small portion of the stepped concave hole forms the concave cavity, a plurality of second radial holes communicating with the large portion of the stepped concave hole are formed in the second annular protrusion, and at least one second radial hole corresponds to the water inlet channel. In this way, the situation that high-pressure water detours to the back of the sealing gasket and consequentially squeezes the sealing gasket can be prevented.

Since the water inlet channel and the water outlet channel of the pressure-reduction and flow-stabilization valve are blocked when the switch valve is in the closed state, the high pressure at the front water supply end can be isolated, a normally-closed electromagnetic valve assembly does not need to be additionally arranged at the front end of the pressure-reduction and flow-stabilization valve assembly, the structure and control of the flushing toilet cover are simplified, structural arrangement of the flushing toilet cover is facilitated, the manufacturing cost can be effectively reduced, and operation is quite simple. On the other hand, since a normally-closed electromagnet valve does not need to be arranged, flushing can be conducted when power failures occur, and the utilization rate of the flushing toilet cover is effectively increased.

DETAILED DESCRIPTION OF THE INVENTION

Figure 1:
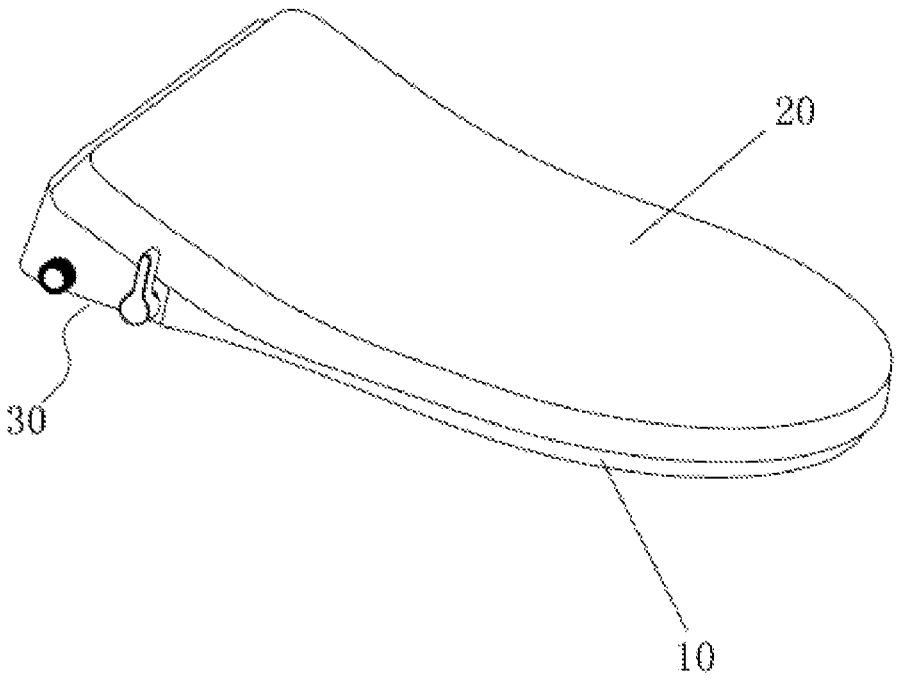
FIG. 1 is a perspective view of the present invention.
Figure 2:
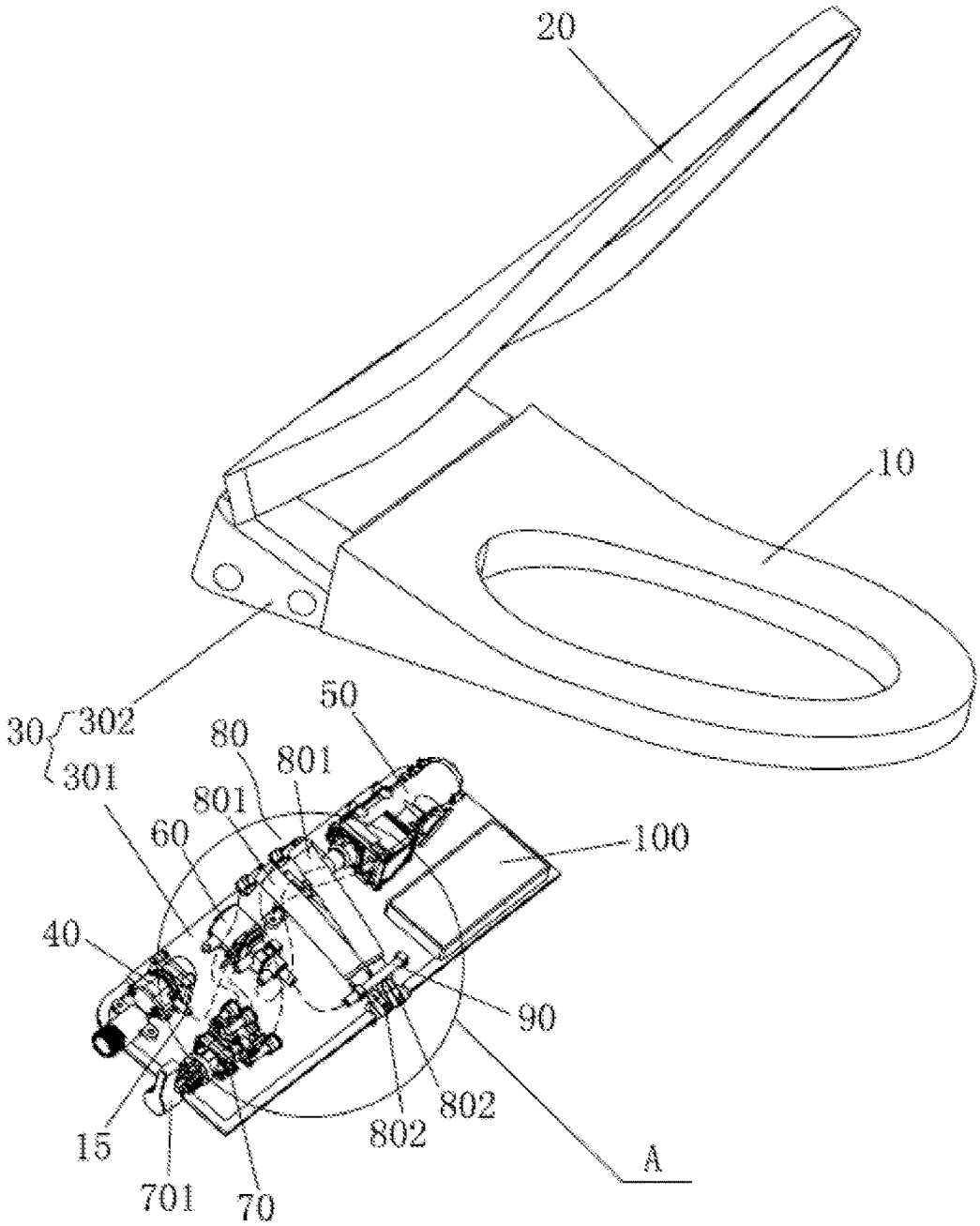
FIG. 2 is a partial, exploded perspective view of the present invention.
Figure 3:
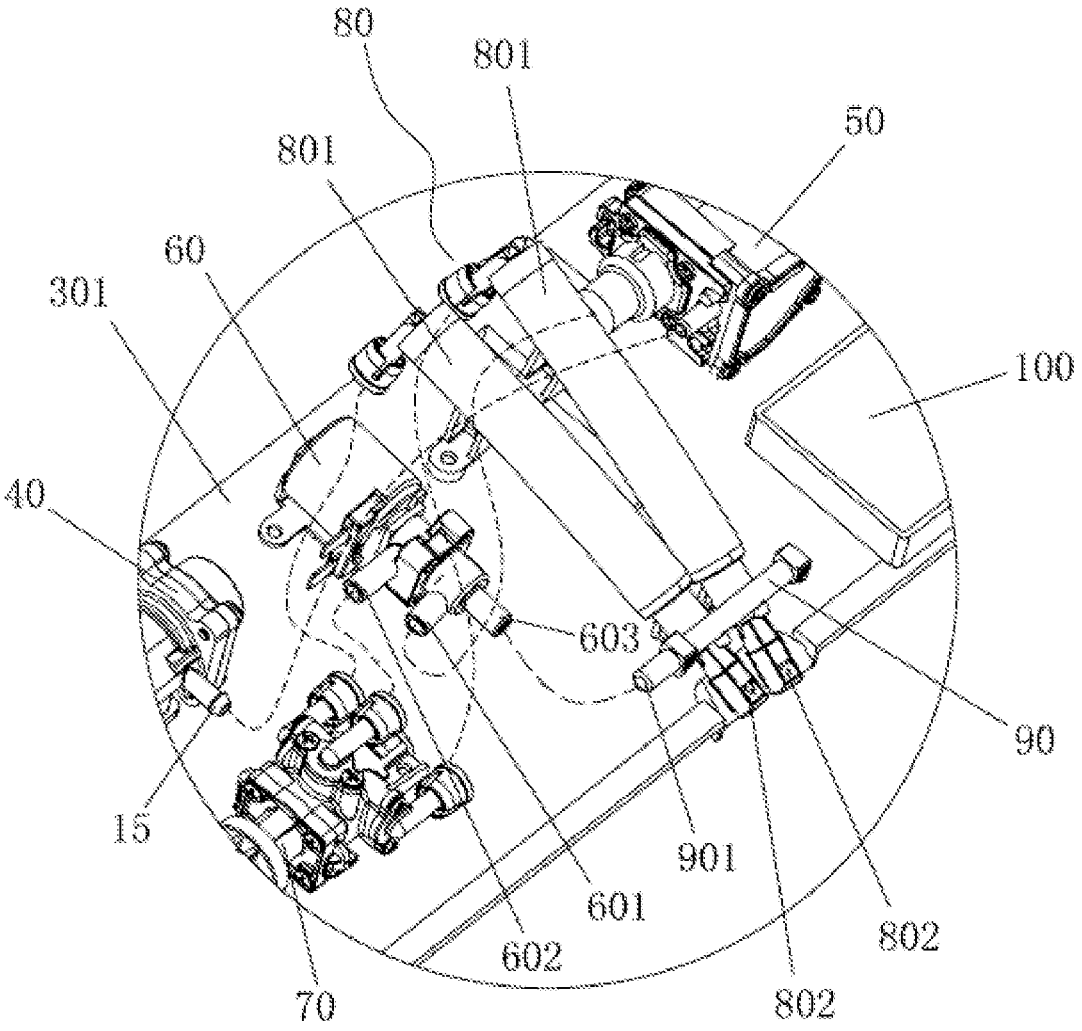
FIG. 3 is an enlarged view of the portion A in FIG. 2.
Figure 4:
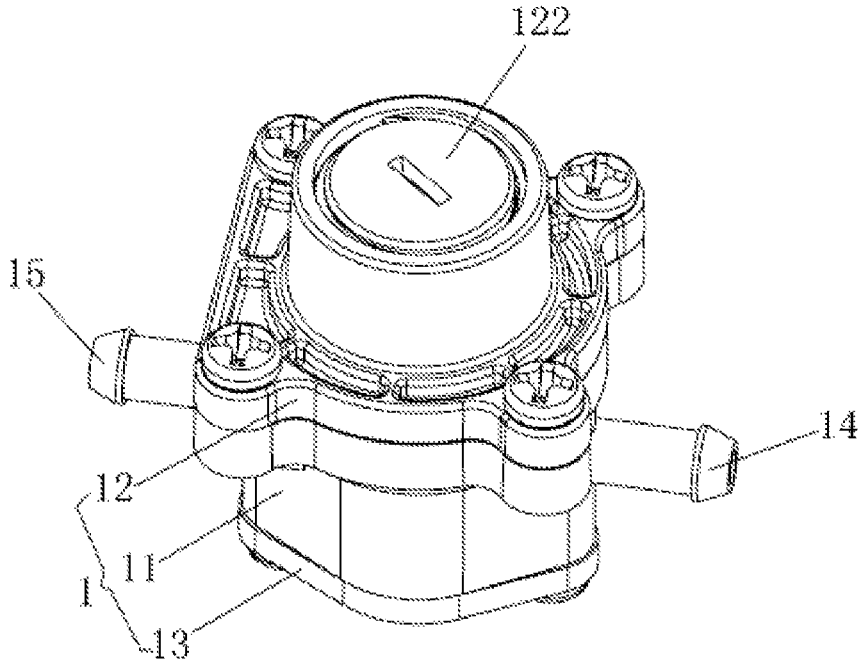
FIG. 4 is a perspective view of a pressure-reduction and flow-stabilization valve.
Figure 5:
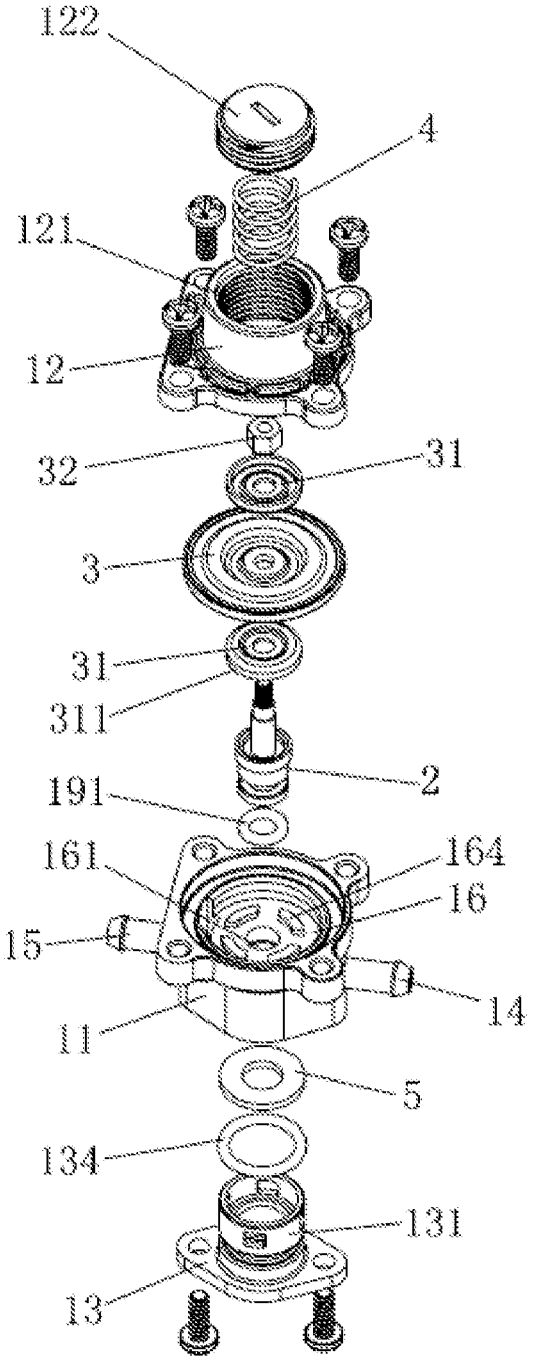
FIG. 5 is an exploded perspective view of the pressure-reduction and flow-stabilization valve.
Figure 6:
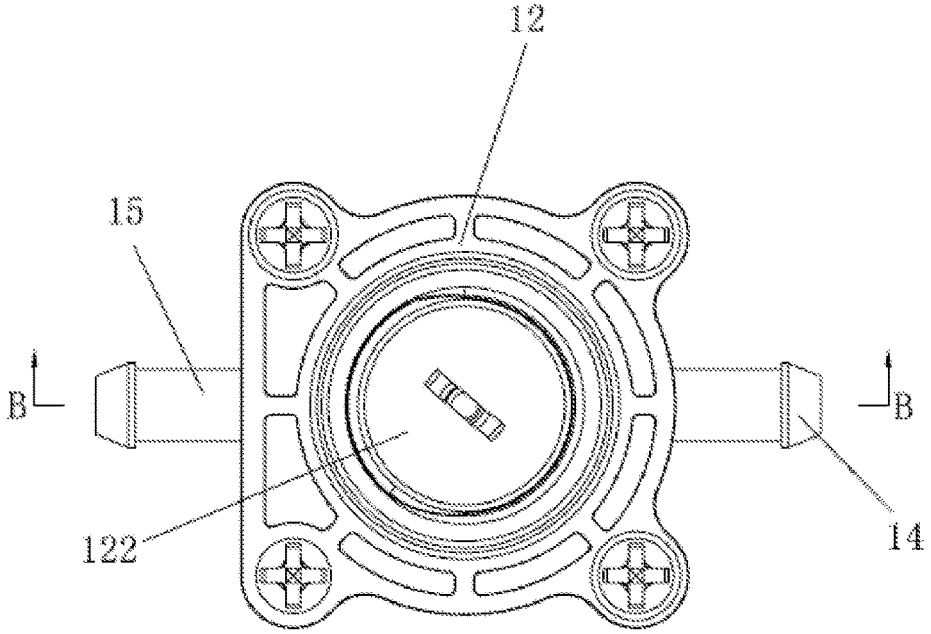
FIG. 6 is a top view of the pressure-reduction and flow-stabilization valve.
Figure 7:
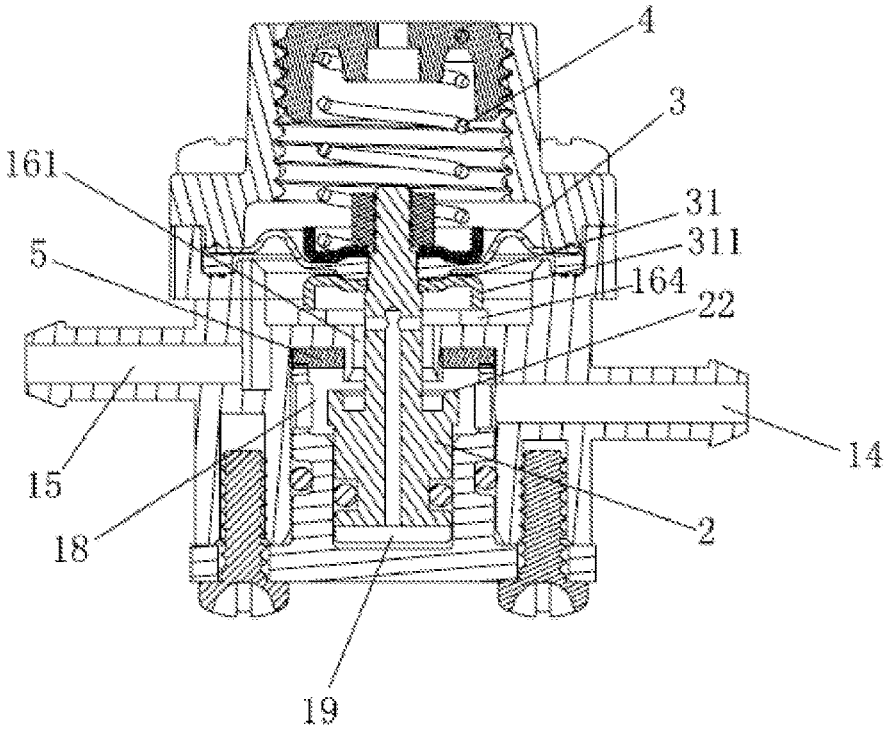
FIG. 7 is a sectional view of the pressure-reduction and flow-stabilization valve in the water-free state taken along line B-B of FIG. 6.
Figure 8:
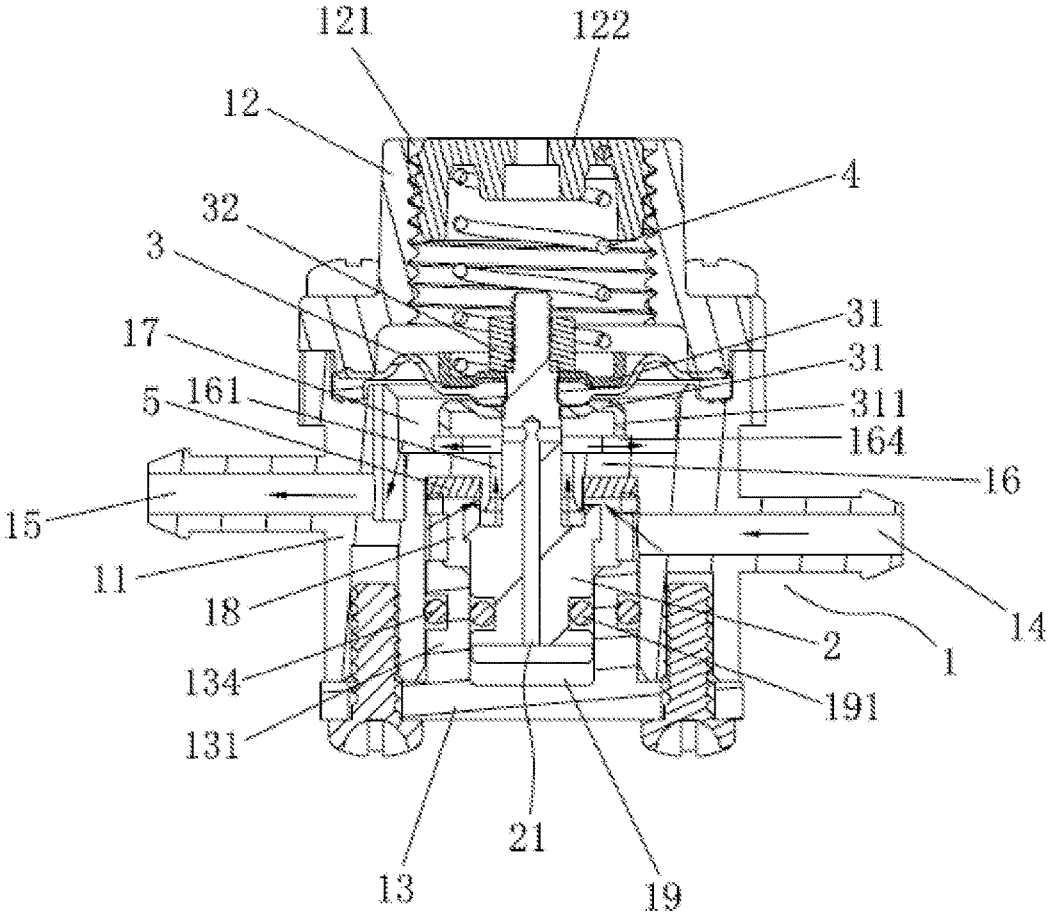
FIG. 8 is a sectional view of the pressure-reduction and flow-stabilization valve in the water inflow operating state taken along line B-B of FIG. 6.
Figure 9:
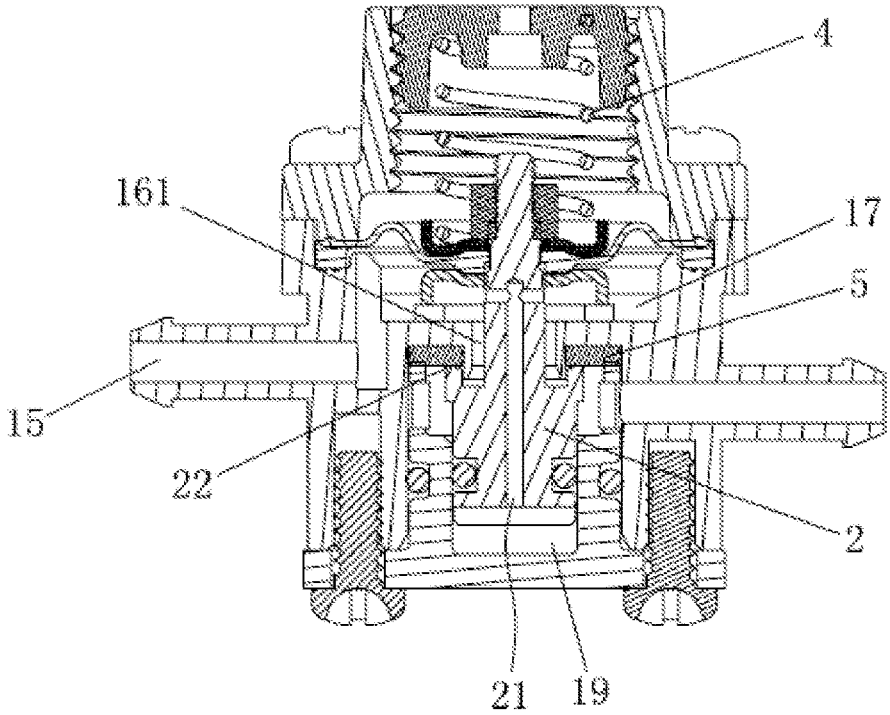
FIG. 9 is a sectional view of the pressure-reduction and flow-stabilization valve when the water outlet channel is in the closed state taken along line B-B of FIG. 6.
Figure 10:
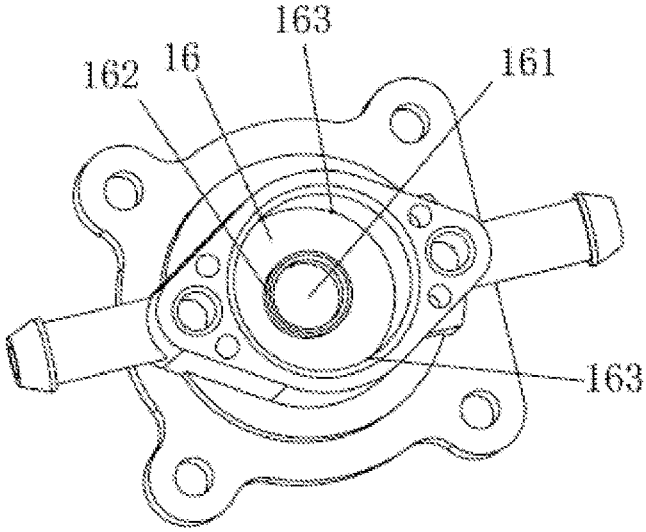
FIG. 10 is a perspective view of a valve body part of the pressure-reduction and flow-stabilization valve.
Figure 11:
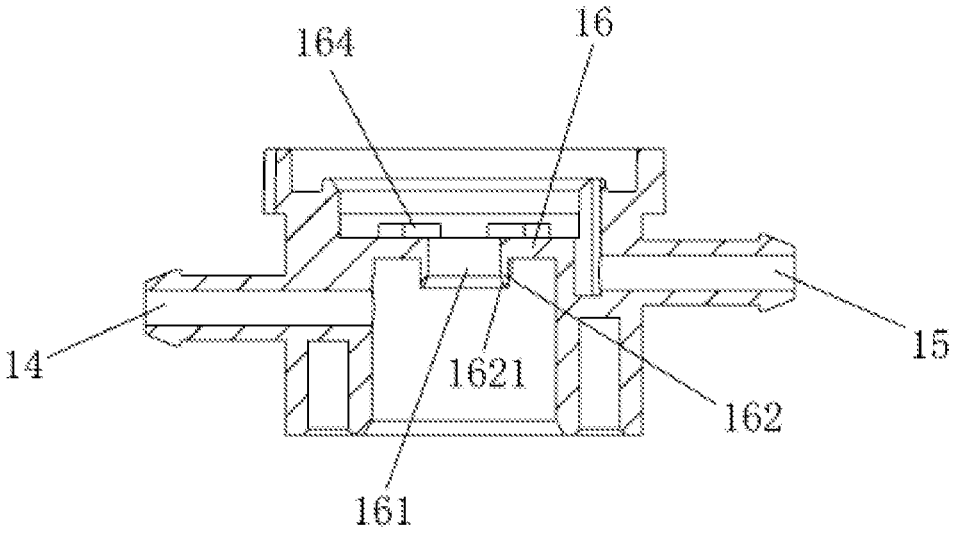
FIG. 11 is an axial sectional view of the valve body part of the pressure-reduction and flow-stabilization valve.
Figure 12:
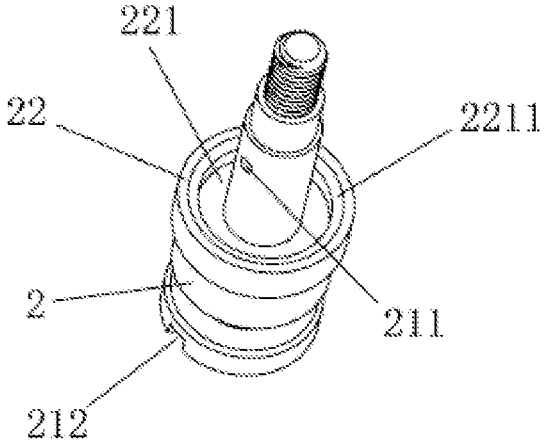
FIG. 12 is a perspective view of a valve element of the pressure-reduction and flow-stabilization valve.
Figure 13:
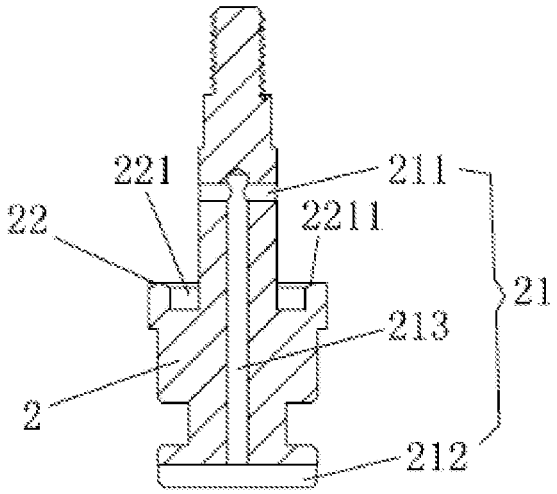
FIG. 13 is an axial sectional view of the valve element of the pressure-reduction and flow-stabilization valve.
Figure 14:
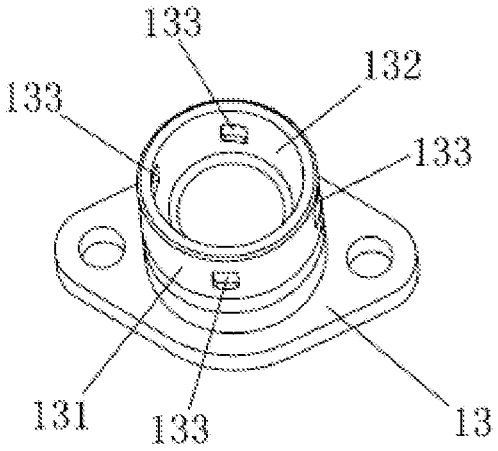
FIG. 14 is a perspective view of a second cover body of the pressure-reduction and flow-stabilization valve.
Figure 15:
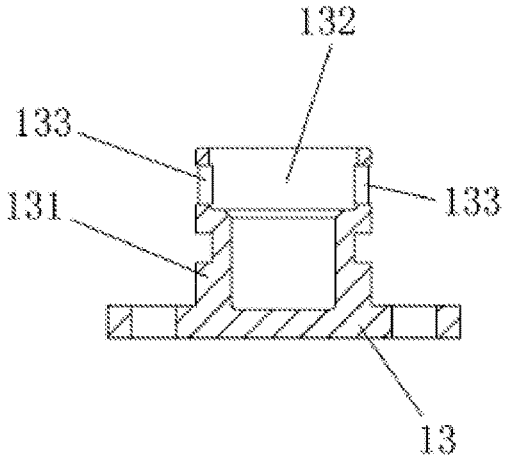
FIG. 15 is an axial sectional view of the second cover body of the pressure-reduction and flow-stabilization valve.

A further detailed description of the present invention is given with accompanying drawings and specific embodiments as follows.

As is shown in FIGS. 1-19, a flushing toilet cover comprises a seating ring 10, a cover plate 20 and a shell 30, wherein the rear portion of the seating ring 10 and the rear portion of the cover plate 20 are hinged to the shell 30, the shell 30 comprises a mounting base plate 301 and a housing 302, the rear portion of the seating ring 10 and the rear portion of the cover plate 20 are specifically hinged to the housing 302 on the shell 30, and the housing 302 and the mounting base plate 301 are fastened through a screw or clamped together in a connected mode; during mounting, the mounting base plate 301 is fixedly connected to a ceramic toilet;

a pressure-reduction and flow-stabilization valve 40, a heating assembly 50, an electromagnetic reversing valve 60, a switch valve 70, a flushing assembly 80, a self-cleaning pipe 90 and a control panel 100 are mounted on the mounting base plate 301 of the shell 30, the pressure-reduction and flow-stabilization valve 40 is provided with a water inlet channel 14 and a water outlet channel 15, the electromagnetic reversing valve 60 is provided with a first port 601, a second port 602 and a third port 603, the switch valve 70 is provided with a water inlet and two water outlets, the self-cleaning pipe 90 is provided with a water inlet 901 and two water outlets 902, the flushing assembly 80 comprises two flushing pipes 801, a telescopic flushing spray head 802 is mounted on each flushing pipe 801, and each flushing pipe 801 is provided with a water inlet;

the water inlet channel 14 of the pressure-reduction and flow-stabilization valve 40 communicates with an external water inlet pipe, the water outlet channel 15 of the pressure-reduction and flow-stabilization valve 40 communicates with a water inlet of the heating assembly 50 through a pipeline, a water outlet of the heating assembly 50 communicates with the first port 601 of the electromagnetic reversing valve 60 through a pipeline, the water inlet of the switch valve 70 communicates with the second port 602 of the electromagnetic reversing valve 60, the third port 603 of the electromagnetic reversing valve 60 communicates with the water inlet 901 of the self-cleaning pipe 90 through a pipeline, and the two water outlets of the switch valve 70 communicate with the water inlets of the two flushing pipes 801 through pipelines respectively;

the self-cleaning pipe 90 is arranged above the flushing spray heads 802, and the two water outlets 902 of the self-cleaning pipe 90 are aligned with water spray nozzles of the two flushing spray heads 802 when the flushing spray heads 802 do not operate; when the electromagnetic reversing valve 60 is powered on, the first port 601 communicates with the third port 603, and when the electromagnetic reversing valve 60 is powered off, the first port 601 communicates with the second port 602; when the control panel 100 judges that water flows through the heating assembly 50, the heating assembly 50 is controlled to conduct heating so as to output hot water; while the control panel 100 judges that water flows through the heating assembly 50, the electromagnetic reversing valve 60 is powered on for a set time (the time can be set as 5-8 seconds) and then is powered off.

The switch valve 70 is a mechanical-control reversing valve, a rotary knob 701 is fixedly connected to a valve element of the switch valve 70, the rotary knob 701 can make the valve element be located at three positions, the switch valve 70 has three operating states, specifically, when the rotary knob 701 makes the valve element be located at the first position and makes the switch valve 70 in the closed state, the two flushing spray heads 802 of the flushing assembly 80 do not work; when the rotary knob 701 makes the valve element be located at the second position and makes the water inlet of the switch valve 70 communicate with one water outlet, namely the switch valve 70 is in the first open state, the water pressure can drive one flushing spray head 802 of the flushing assembly 80 to stretch out to the middle of the seating ring 10 for hip flushing; when the rotary knob 701 makes the valve element be located at the third position and makes the water inlet of the switch valve 70 communicate with the other water outlet, namely the switch valve 70 is in the second open state, the water pressure can drive the other flushing spray head 802 of the flushing assembly 80 to stretch out to the middle of the seating ring 10 for gynecological flushing.

An instant heating assembly can be used as the heating assembly 50, the heating assembly 50 comprises an inner cavity and an electric heating pipe arranged in the inner cavity, and a flow sensor is arranged at a water inlet of the heating assembly 50 and electrically connected with a control panel 100; once the switch valve 70 is opened, the flow sensor can detect a flow signal and transmits the flow signal to the control panel 100, and the electric heating pipe in the heating assembly 50 is powered on by the control panel 100 and then starts heating; meanwhile, the control panel 100 can also power on the electromagnetic reversing valve 60 for several seconds (for example 5-8 seconds) and then power off the electromagnetic reversing valve 60. In this way, water recently entering the self-cleaning pipe 90 can wash the water spray nozzles of the flushing spray heads 802, so that discomfort caused by recent low-temperature cold water which flows out is prevented, or people are prevented from being scalded by recent high-temperature water that flows out.

Figure 16:
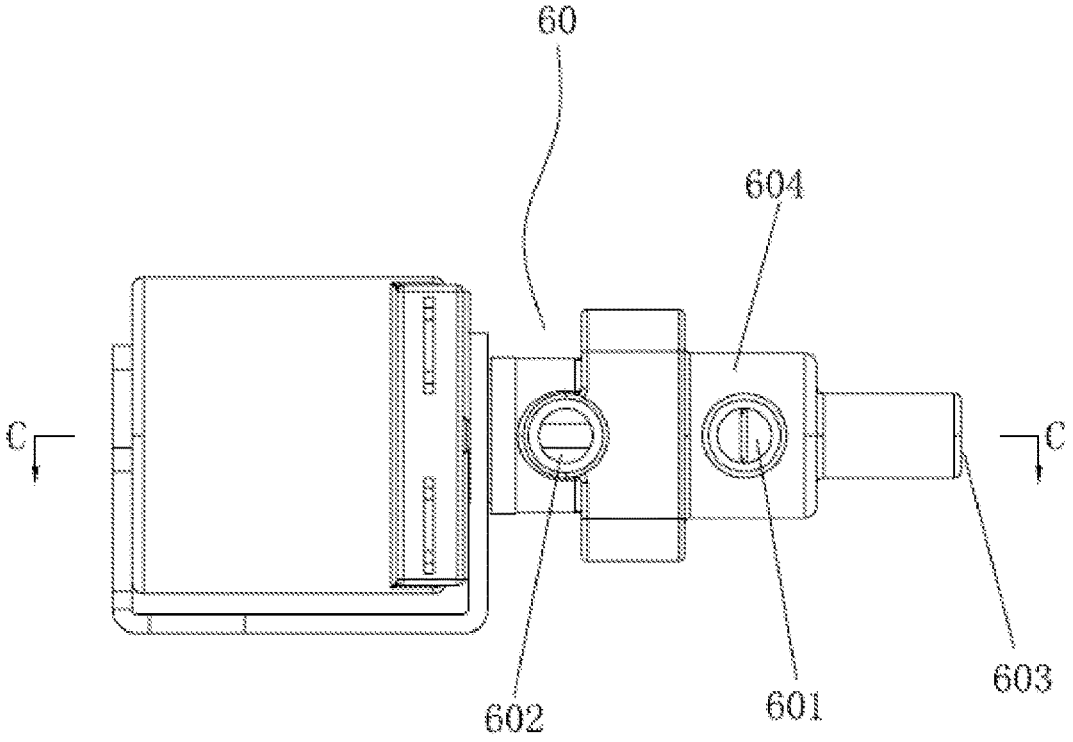
FIG. 16 is a front view of an electromagnetic reversing valve.
Figure 17:
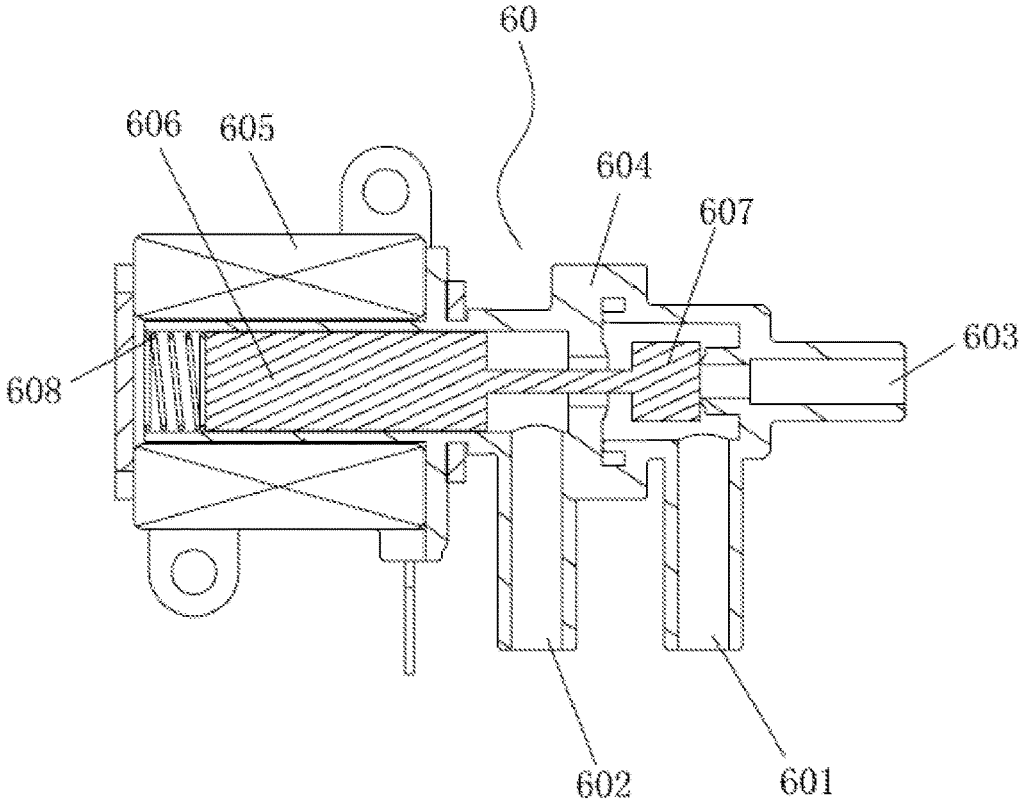
FIG. 17 is a sectional view of the electromagnetic reversing valve in the power-off state taken along line C-C of FIG. 16.
Figure 18:
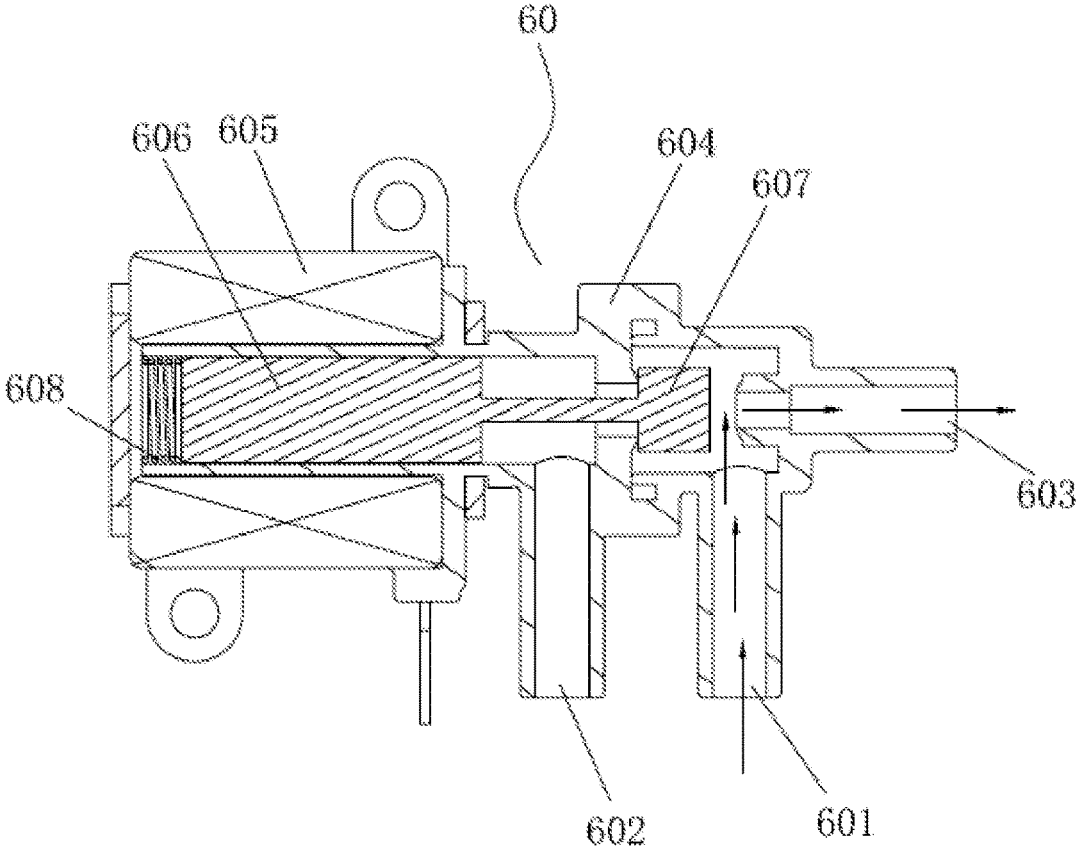
FIG. 18 is a sectional view of the electromagnetic reversing valve in the power-on state taken along line C-C of FIG. 16.
Figure 19:
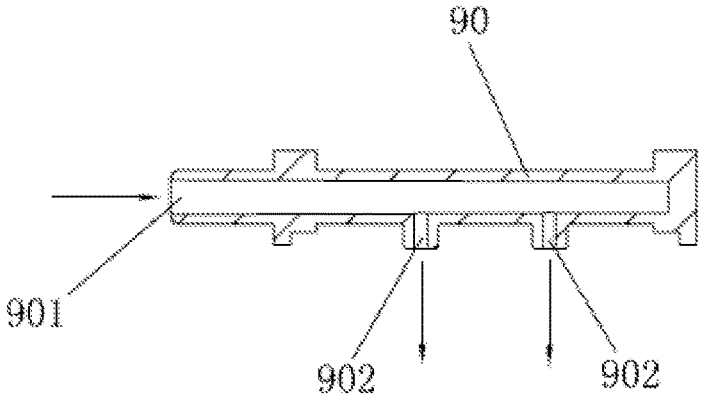
FIG. 19 is an axial sectional view of a self-cleaning pipe.

As is shown in FIGS. 16-18, the electromagnetic reversing valve 60 further comprises a valve body 604, an electromagnetic coil 605, an iron core 606, a plug 607 and a spring 608, the first port 601, the second port 602 and the third port 603 of the electromagnetic reversing valve 60 are arranged on the valve body 604, the iron core 606 and the spring 608 are mounted in a central hole of the electromagnetic coil 605, one end of the iron core 606 is fixedly connected with the plug 607, and the other end of the iron core 606 is connected with the spring 608. As is shown in FIG. 17, when the electromagnetic coil 605 is not powered on, the spring 608 pushes the iron core 606 to move forwards, the iron core 606 drives the plug 607 to block a channel of the third port 603, and the first port 601 communicates with the second port 602 at the moment; as is shown in FIG. 18, when the electromagnetic coil 605 is powered on, attraction force generated by the electromagnetic coil 605 overcomes the elastic force of the spring 608 to make the iron core 606 retract, the iron core 606 drives the plug 607 to block a channel of the second port 602, and the first port 601 communicates with the third port 603 at the moment.

As is shown in FIGS. 4-15, the pressure-reduction and flow-stabilization valve 40 comprises a valve body 1 and a valve element 2, wherein the valve body 11 comprises a valve body part 11, a first cover body 12 and a second cover body 13, the water inlet channel 14 and the water outlet channel 15 are arranged on the valve body part 11, an interlayer 16 is arranged in the middle of an inner cavity of the valve body part 11, the first cover body 12 is fixedly connected with one end of the valve body part 11 through a bolt, the second cover body 13 is fixedly connected with the other end of the valve body part 11 through a bolt, a low-pressure cavity 17 of the valve body 1 is formed by the first cover body 12, one side of the interlayer 16 and the inner wall of the valve body part 11, a high-pressure cavity 18 of the valve body 1 is formed by the second cover body 13, the other side of the interlayer 16 and the inner wall of the valve body part 11, namely the inner cavity of the valve body 1 is divided into the high-pressure cavity 18 and the low-pressure cavity 17 by an interlayer 16, the high-pressure cavity 18 communicates with the water inlet channel 14, the low-pressure cavity 17 communicates with the water inlet channel 15, and a first communicating hole 161 is formed in the interlayer 16 and communicates with the high-pressure cavity 18 and the low-pressure cavity 17.

The valve element 2 penetrates through the first communicating hole 161 to be located in the low-pressure cavity 17, and the other end of the valve element 2 is located in the high-pressure cavity 18; a membrane 3 is mounted on the side, located on the low-pressure cavity 17, of the valve body part 11, and the edge of the membrane 3 is clamped between the first cover body 12 and the vale body part 11; one end of the valve element 2 is fixedly connected with the membrane 3, and a compression spring 4 is connected to the side, away from the high-pressure cavity 18, of the membrane 3; according to the specific structure, metal gaskets 31 are arranged on the two sides of the middle of the membrane 3 respectively, one end of the valve element 2 penetrates through the two metal gaskets 31 and the membrane 3 and is screwed with a locking nut 32, one end of the valve element 2, the two metal gaskets 31 and the membrane 3 are fixedly connected together by screwing the locking nut 32, a through hole 121 is formed in the middle of the outer end face of the first cover body 12, an adjusting nut 122 is connected to the through hole 121 in a screwed mode, one end of the compression spring 4 abuts against one metal gasket 31, and the other end of the compression spring abuts against the adjusting nut 122. The elastic force of the compression spring 4 can be adjusted conveniently through the adjusting nut 122, and thus operating parameters of the pressure-reduction and flow-stabilization valve 40 can be adjusted conveniently.

A concave cavity 19 is formed in the side, located in the high-pressure cavity 18, of the valve body 1, according to the specific structure, a second annular protrusion 131 extends from the side, close to the interlayer 16, of the second cover body 13, a stepped concave hole 132 which becomes larger from inside to outside is formed in the middle of the second annular protrusion 131, the small portion of the stepped concave hole 132 forms the concave cavity 19, the other end of the valve element 2 is inserted into the concave cavity 19, and a sealing ring 191 is arranged between the outer side face of the other end of the valve element 2 and the inner side face of the concave cavity 19; a second communicating hole 21 is formed in the valve element 2, and the second communicating hole 21 communicates with the low-pressure cavity 17 and the bottom of the concave cavity 19; the second communicating hole 21 comprises a first radial through hole 211 which is formed in the portion, located in the low-pressure cavity 17, of the valve element 2, a U-shaped groove 212 which is formed in the end, located in the high-pressure cavity 18, of the valve element 2, and an axial hole 213 which communicates with the first radial through hole 211 and the U-shaped groove 212 and is located on the valve element 2.

A sealing gasket 5 is fixedly connected to the side, located in the high-pressure cavity 18, of the interlayer 16 and located on the periphery of the first communicating hole 161, according to the specific structure, the sealing gasket 5 is a round rubber gasket or a silica gel gasket, a first annular protrusion 162 extends out from the side, located in the high-pressure cavity 18, of the interlayer 16 and located on the periphery of the first communicating hole 161, the sealing gasket 5 surrounds the first annular protrusion 162, the thickness of the sealing gasket 5 is smaller than the height of the first annular protrusion 162, and the sealing gasket 5 is pressed by the end face of the second annular protrusion 131 on the second cover body 13, so that the sealing gasket 5 and the side, located in the high-pressure cavity 18, of the interlayer 16 are fixedly connected; four second radial holes 133 which communicate with the large portion of the stepped concave hole 132 are formed in the second annular protrusion 131, and one second radial hole 133 corresponds to the water inlet channel 14. The second radial holes 133 are used for allowing flow to pass.

A shoulder 22 is arranged on the portion, located in the high-pressure cavity 18, of the valve element 2, when the pressure of the low-pressure cavity 17 is increased to a set value, the water pressure of the low-pressure cavity 17 drives the membrane 3, is transmitted to the concave cavity 19 through the second communicating hole 21, and then overcomes the elastic force of the compression spring 4 to push the valve element 2 to move towards the low-pressure cavity 17 until the sealing gasket 5 is pressed by the end face of the shoulder 22, and the first communicating hole 161 is sealed. The high-pressure cavity 18 and the low-pressure cavity 17 are in the blocked state at the moment. In this way, when the switch valve 70 is in the closed state, the water inlet channel 14 and the water outlet channel 15 of the pressure-reduction and flow-stabilization valve 40 are isolated from the high pressure of the water inlet end, and a hose and a connector located at the rear end of the pressure-reduction and flow-stabilization valve 40 are protected.

An annular groove 221 is formed in the end, matched with the sealing gasket 5, of the shoulder 22, the first annular protrusion 162 can stretch into the annular groove 221, and when the first annular protrusion 162 stretches into the annular groove 221, a gap is reserved between the inner circumference surface of the annular groove 221 and the outer circumferential surface of the first annular protrusion 162.

A first chamfer 2211 is arranged at the end, close to the first annular protrusion 162, of the inner circumferential surface of the annular groove 221, and the first chamfer 2211 can have a guiding function so that the first annular protrusion 162 can stretch into the annular groove 221 conveniently when the first annular protrusion 162 moves relative to the annular groove 221; a second chamfer 1621 is arranged at the end, close to the annular groove 221, of the inner circumferential surface of the first annular protrusion 162, and the second chamfer 1621 allows water to enter the second communicating hole 161 conveniently.

A plurality of convex ribs 163 are arranged at the junction of the inner side face of the valve body part 11 and the side, located in the high-pressure cavity 18, of the interlayer 16 at intervals, and the height of the convex ribs 163 is smaller than the height of the first annular protrusion 162. The sealing gasket 5 can be isolated from the inner side face of the valve body part 11 through the multiple convex ribs 163, and the situation that when the sealing gasket 5 is mounted, the sealing gasket 5 cannot be attached to the interlayer 16 due to the fact that an airtight space is formed between the sealing gasket 5 and the interlayer 16, and consequentially the blocking performance of the pressure-reduction and flow-stabilization valve 40 is affected is prevented.

Flanges 311 extend out from the edges of the metal gaskets 31, a plurality of lugs 164 are arranged on the side, located in the low-pressure cavity 17, of the interlayer 16, the compression spring 4 is prevented from continuing to drive the membrane 3 to move towards the high-pressure cavity 18 when the flanges 311, located in the low-pressure cavity 17, of the metal gaskets 31 make contact with the lugs 164, and a water channel is formed by the space between the adjacent lugs 164.

A sealing ring 134 is arranged between the outer circumferential surface of the second annular protrusion 131 and the inner wall of the valve body part 11.

According to the operating process of the flushing toilet cover in the embodiment, when the switch valve 70 is in the closed state, no water enters the flushing assembly 80, and the two flushing spray heads 802 do not work. The water outlet channel 15 of the pressure-reduction and flow-stabilization valve 40 is closed at the moment, the pressure of the low-pressure cavity of the pressure-reduction and flow-stabilization valve 40 is increased, when the pressure of the low-pressure cavity 17 reaches a set value, the water pressure in the low-pressure cavity 17 drives the membrane 3, is transmitted to the concave cavity 19 through the second communicating hole 21 and then overcomes the elastic force of the compression spring 4 so as to push the valve element 2 to move towards the low-pressure cavity 17 until the sealing gasket 5 is pressed by the end face of the shoulder 22, and the first communicating hole 161 is sealed, the pressure-reduction and flow-stabilization valve 40 is in the blocking state, and the flushing toilet cover does not work.

When flushing work is needed, the rotary knob 701 makes the water inlet of the switch valve 70 communicate with one water outlet, the water outlet channel 15 of the pressure-reduction and flow-stabilization valve 40 releases pressure firstly, the valve element 2 moves towards the high-pressure cavity 18 to open the first communicating hole 161, water starts to enter the water inlet channel 14 of the pressure-reduction and flow-stabilization valve 40, water pressure is generated in the low-pressure cavity 17 of the pressure-reduction and flow-stabilization valve 40, the water pressure drives the membrane 3, is transmitted to the concave cavity 19 through the second communicating hole 21 and then drives the valve element 2 to move towards the low-pressure cavity 17, the distance between the shoulder 22 on the valve element 2 and the sealing gasket 5 is decreased at the moment, the flow sectional area of water from the high-pressure cavity 18 to the low-pressure cavity 17 is decreased, and under the condition, the flow sectional area of water can be decreased along with increment of the pressure of the water inlet channel 14 and can be increased along with decrement of the pressure of the water inlet channel 14, so that the pressure reduction and flow stabilization effect on the water outlet end can be achieved, and pressure reduction and flow stabilization of a pipeline behind the pressure-reduction and flow-stabilization valve 40 are ensured;

under the condition, the flow sensor in the heating assembly 50 can detect a flow signal and transmits the flow signal to the control panel 100, the control panel 100 can power on the electric heating pipe in the heating assembly 50, and then heating is conducted; meanwhile, the control panel 100 can power on the electromagnetic reversing valve 60 for several seconds (such as 5-8 seconds) and then power off the electromagnetic reversing valve 60. When the water temperature in the pipeline is low, the water spray nozzles of the flushing spray heads 802 is washed with water recently entering the self-cleaning pipe 90, original cold water is heated at the moment so as to be used for cleaning the flushing spray heads 802 automatically, and thus discomfort of people caused by flushing with cold water is avoided; or when the water temperature in the inner cavity of the heating assembly 50 is too high due to frequent opening of the switch valve 70, recent water also enters the self-cleaning pipe 90 to wash the water spray nozzles of the flushing spray heads 802, and thus the situation that people are scalded due to the fact that the water temperature is too high is avoided.

After the electromagnetic reversing valve 60 is powered off, water at the proper temperature enters the flushing assembly 80, one flushing spray head 802 stretches to the middle of the seating ring 10 for flushing work, and hip flushing or gynecological flushing can be selected by rotating the rotary knob 701.

By adoption of the flushing toilet cover in the embodiment, flushing can be conducted under the power failure condition.

The foregoing description is only one preferred embodiment of the present invention, equivalent changes made by those skilled in the field according to the claims are all within the protection scope of the scheme.

What is claimed is:

1. A flushing toilet cover, comprising a seating ring, a cover plate and a shell, wherein the rear portion of the seating ring and the rear portion of the cover plate are hinged to the shell; wherein a pressure-reduction and flow-stabilization valve, a heating assembly, a switch valve, a flushing assembly and a control panel are mounted in the shell, the pressure-reduction and flow-stabilization valve is provided with a water inlet channel and a water outlet channel, the switch valve is provided with a water inlet and at least one water outlet, the flushing assembly comprises at least one flushing pipe, telescopic flushing spray heads are mounted on the flushing pipes, and water inlets are formed in the flushing pipes;

the water inlet channel of the pressure-reduction and flow-stabilization valve communicates with an external water inlet pipe, the water outlet channel of the pressure-reduction and flow-stabilization valve communicates with a water inlet of the heating assembly through a pipeline, a water outlet of the heating assembly communicates with the water inlet of the switch valve, and the water outlets of the switch valve communicate with the water inlets of the flushing pipes;

the control panel controls the operating state of the heating assembly, and when the switch valve is in the closed state, the water inlet channel and the water outlet channel of the pressure-reduction and flow-stabilization valve are blocked.

2. The flushing toilet cover according to claim 1, wherein the switch valve is provided with two water outlets, the flushing assembly comprises two flushing pipes, a telescopic flushing spray head is mounted on each flushing pipe, and a water inlet is formed in each flushing pipe; the two water outlets on the switch valve communicate with the water inlets on the two flushing pipes through two pipelines correspondingly, a rotary knob is mounted on the switch valve, and the switch valve can be made in the closed state or the water inlet of the switch valve can communicate with one water outlet on the switch valve by rotating the rotary knob.

3. The flushing toilet cover according to claim 1, wherein an electromagnetic reversing valve and a self-cleaning pipe are further mounted in the shell, the electromagnetic reversing valve is provided with a first port, a second port and a third port, the self-cleaning pipe is provided with a water inlet and at least one water outlet, the water outlet of the heating assembly communicates with the first port of the electromagnetic reversing valve through a pipeline firstly, the water inlet of the switch valve then communicates with the second port of the electromagnetic reversing valve through a pipeline, the third port of the electromagnetic reversing valve communicates with the water inlet of the self-cleaning pipe through a pipeline, and the self-cleaning pipe is arranged above the flushing spray heads, and the water outlets of the self-cleaning pipe are aligned with water spray nozzles of the flushing spray heads when the flushing spray heads do not operate; when the electromagnetic reversing valve is powered on, the first port communicates with the third port, and when the electromagnetic reversing valve is powered off, the first port communicates with the second port; when the control panel judges that water flows through the heating assembly, the electromagnetic reversing valve is powered on for a set time and then is powered off.

4. The flushing toilet cover according to claim 1, wherein the heating assembly comprises an inner cavity and an electric heating pipe arranged in the inner cavity, a flow sensor is arranged at the water inlet of the heating assembly and electrically connected with the control panel, when the switch valve is opened, the flow sensor detects a flow signal and transmits the flow signal to the control panel, and the electric heating pipe in the heating assembly is powered on through the control panel and then starts heating.

5. The flushing toilet cover according to claim 1, wherein the pressure-reduction and flow-stabilization valve comprises a valve body and a valve element, the water inlet channel and the water outlet channel are arranged on the valve body, an inner cavity of the valve body is divided into a high-pressure cavity and a low-pressure cavity by an interlayer, the high-pressure cavity communicates with the water inlet channel, the low-pressure cavity communicates with the water outlet channel, and a first communicating hole is formed in the interlayer and communicates with the high-pressure cavity and the low-pressure cavity; the valve element penetrates through the first communicating hole to be located in the low-pressure cavity, and the other end of the valve element is located in the high-pressure cavity; a membrane is mounted on the side, located in the low-pressure cavity, of the valve body, one end of the valve element is fixedly connected with the membrane, and a compression spring is connected to the side, away from the high-pressure cavity, of the membrane; a concave cavity is formed in the side, located in the high-pressure cavity, of the valve body, the other end of the valve element is inserted into the concave cavity, and a sealing ring is arranged between the outer side face of the other end of the valve element and the inner side face of the concave cavity; a second communicating hole is formed in the valve element and communicates with the low-pressure cavity and the bottom of the concave cavity; a sealing gasket is fixedly connected to the side, located in the high-pressure cavity, of the interlayer and located on the periphery of the first communicating hole, a shoulder is arranged on the portion, located in the high-pressure cavity, of the valve element, when the pressure of the low-pressure cavity is increased to a set value, the water pressure of the low-pressure cavity drives the membrane, is transmitted to the concave cavity through the second communicating hole, and then overcomes the elastic force of the compression spring to push the valve element to move towards the low-pressure cavity until the sealing gasket is pressed by the end face of the shoulder, and the first communicating hole is sealed.

6. The flushing toilet cover according to claim 5, wherein a first annular protrusion extends out from the side, located in the high-pressure cavity, of the interlayer and is located on the periphery of the first communicating hole, the sealing gasket surrounds the first annular protrusion, the thickness of the sealing gasket is smaller than the height of the first annular protrusion, an annular groove is formed in the end, matched with the sealing gasket, of the shoulder, the first annular protrusion can stretch into the annular groove, and when the first annular protrusion stretches into the annular groove, a gap is reserved between the inner circumference surface of the annular groove and the outer circumferential surface of the first annular protrusion.

7. The flushing toilet cover according to claim 6, wherein a first chamfer is arranged at the end, close to the first annular protrusion, of the inner circumferential surface of the annular groove, and a second chamfer is arranged at the end, close to the annular groove, of the inner circumferential surface of the first annular protrusion;

a plurality of convex ribs is arranged at the junction of the inner side face of the valve body and the side, located in the high-pressure cavity, of the interlayer at intervals, and the height of the convex ribs is smaller than the height of the first annular protrusion.

8. The flushing toilet cover according to claim 5, wherein the second communicating hole comprises a first radial through hole which is formed in the portion, located in the low-pressure cavity, of the valve element, a U-shaped groove which is formed in the end, located in the high-pressure cavity, of the valve element, and an axial hole which communicates with the first radial through hole and the U-shaped groove and is located on the valve element.

9. The flushing toilet cover according to claim 5, wherein the valve body comprises a valve body part, a first cover body and a second cover body, the water inlet channel and the water outlet channel are arranged on the valve body part, the interlayer is arranged in the middle of an inner cavity of the valve body part, the first cover body is fixedly connected with one end of the valve body part, the second cover body is fixedly connected with the other end of the valve body part, the low-pressure cavity is formed by the first cover body, one side of the interlayer and the inner wall of the valve body part, the high-pressure cavity is formed by the second cover body, the other side of the interlayer and the inner wall of the valve body part, the membrane is clamped between the first cover body and one end of the valve body part, and the compression spring is located between the first cover body and the membrane.

10. The flushing toilet cover according to claim 9, wherein metal gaskets are arranged on the two sides of the middle of the membrane respectively, one end of the valve element penetrates through the two metal gaskets and the membrane and is screwed with a locking nut, one end of the valve element, the two metal gaskets and the membrane are fixedly connected together by screwing the locking nut, a through hole is formed in the middle of the outer end face of the first cover body, an adjusting nut is connected to the through hole in a screwed mode, one end of the compression spring abuts against one metal gasket, the other end of the compression spring abuts against the adjusting nut;

flanges extend out from the edges of the metal gaskets, a plurality of lugs are arranged on the side, located in the low-pressure cavity, of the interlayer, the compression spring is prevented from continuing to drive the membrane to move towards the high-pressure cavity when the flanges, located in the low-pressure cavity, of the metal gaskets make contact with the lugs, and a water channel is formed by the space between the adjacent lugs;

a second annular protrusion extends from the side, close to the interlayer, of the second cover body, and the sealing gasket is pressed by the end face of the second annular protrusion; a stepped concave hole which becomes larger from inside to outside is formed in the middle of the second annular protrusion, the small portion of the stepped concave hole forms the concave cavity, a plurality of second radial holes communicating with the large portion of the stepped concave hole are formed in the second annular protrusion, and at least one second radial hole corresponds to the water inlet channel.

* * * * *